US006550813B1

(12) United States Patent
Siegrist

(10) Patent No.: US 6,550,813 B1
(45) Date of Patent: Apr. 22, 2003

(54) REUSABLE INFORMATION TAG

(76) Inventor: Donna J. Siegrist, 2429 W. Huntington Dr., Peoria, IL (US) 61614

( * ) Notice: Subject to any disclaimer, the term of this patent is extended or adjusted under 35 U.S.C. 154(b) by 0 days.

(21) Appl. No.: 09/853,792

(22) Filed: May 11, 2001

(51) Int. Cl.[7] ..... B42D 15/00

(52) U.S. Cl. ..... 283/74; 283/107; 283/75; 283/70; 40/299

(58) Field of Search ..... 283/74, 75, 77, 283/78, 80, 107, 109, 105, 101, 81; 40/299, 360, 625, 626, 630, 633, 634, 638; 206/459.1, 575, 229, 232

(56) References Cited

U.S. PATENT DOCUMENTS 4,648,189 A * 3/1987 Michel ..... 283/109
4,757,901 A 7/1988 Woods
5,024,332 A 6/1991 Stachler
5,040,296 A 8/1991 Yerger
5,186,499 A 2/1993 Mason
5,381,617 A 1/1995 Schwartztol et al.
5,431,451 A 7/1995 Bork et al.
5,467,871 A 11/1995 DeField
D408,449 S 4/1999 Ho
5,900,307 A * 5/1999 Barcikowski ..... 283/74
D415,526 S * 10/1999 Ho ..... D19/52
6,067,266 A 5/2000 Donelan
6,092,932 A * 7/2000 Pekala et al. ..... 383/75

* cited by examiner

*Primary Examiner*—Willmon Fridie, Jr.
(74) *Attorney, Agent, or Firm*—Gist Fleshman

(57) ABSTRACT

A reusable information tag is provided with a substrate bonded on its top surface to a middle layer which has graphics and indicia disposed upon its top surface, the middle layer being bonded to a transparent or translucent top layer of a nonporous writable and erasable film. A reusable means for attachment is provided. The tag may be written upon with a pen and attached to a gift, luggage or other article. It may then be easily detached, erased and reused. An unlimited variety of tags containing different graphics and indicia for every holiday, occasion, event, use and interest may be easily and inexpensively manufactured. A kit for making the tag is also provided. Alternative embodiments provide for disposing the graphics and indicia on either the top surface of the substrate or the bottom surface of the top layer.

4 Claims, 4 Drawing Sheets

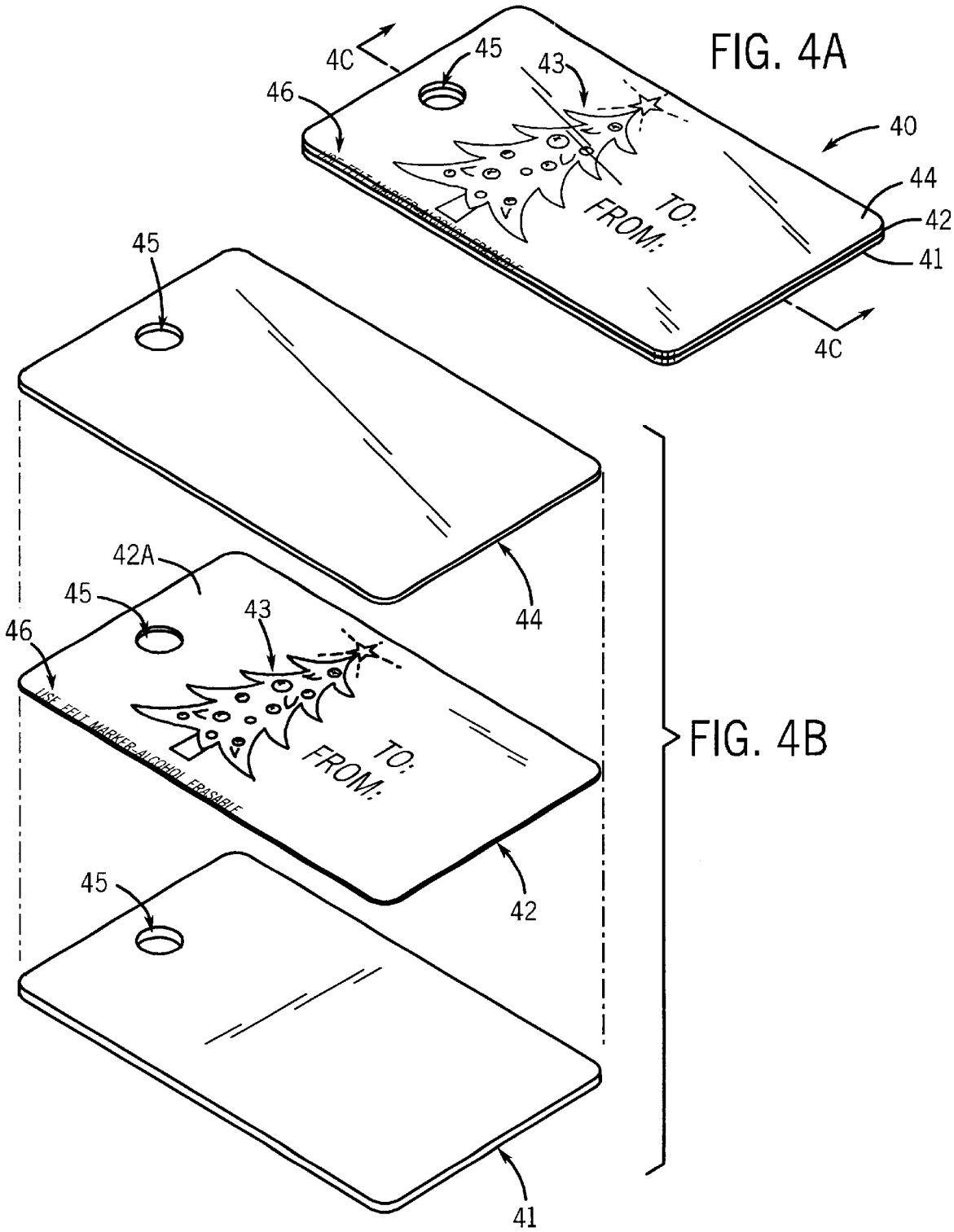
FIG. 4A
FIG. 4B
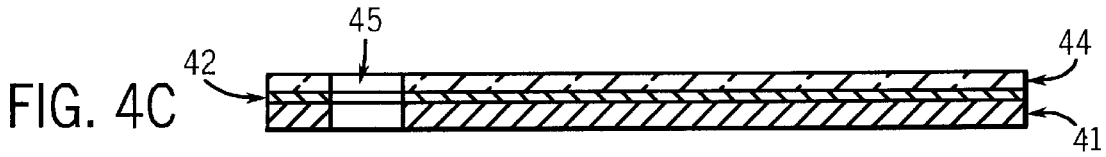
FIG. 4C

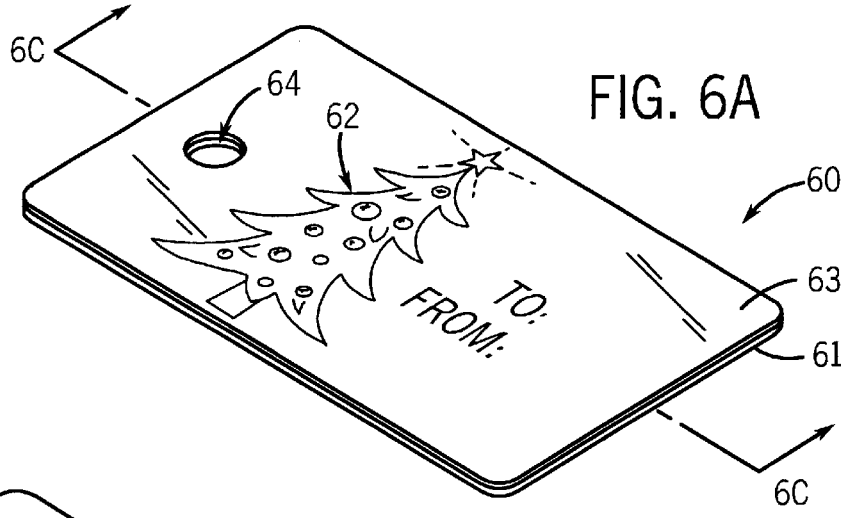
FIG. 6A
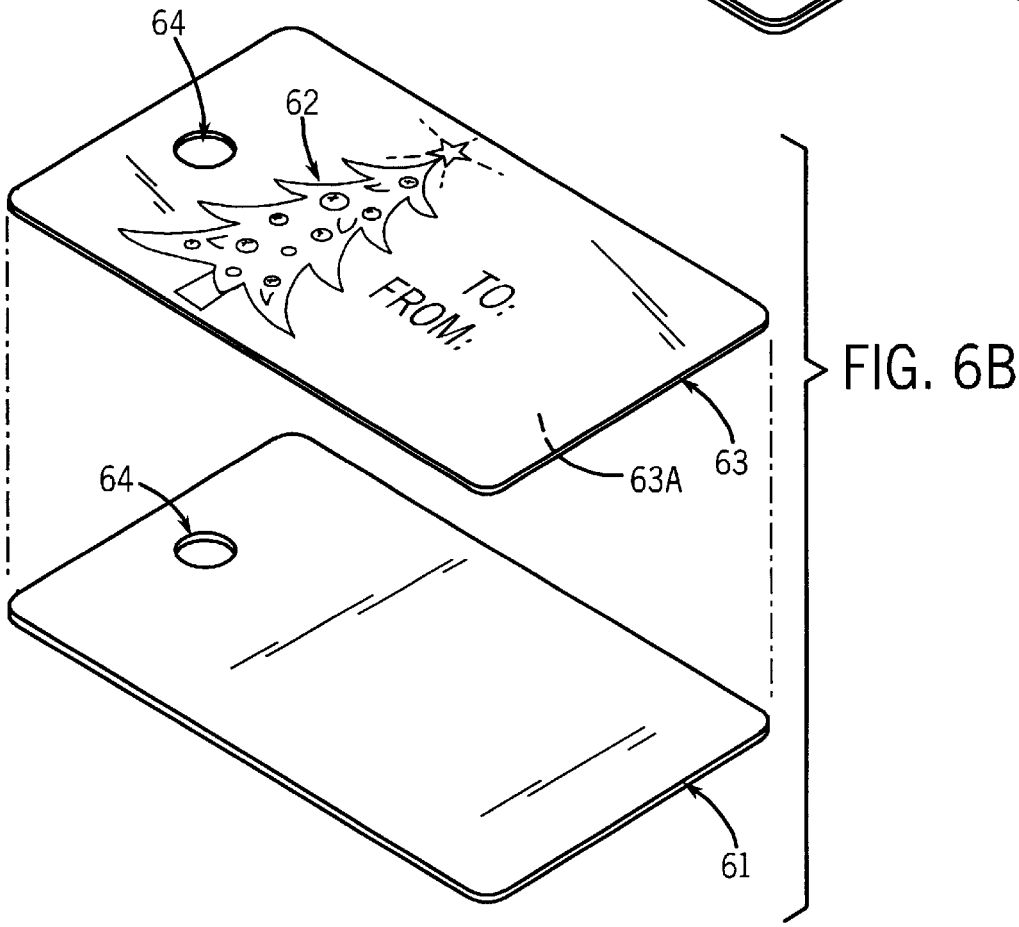
FIG. 6B
FIG. 6C
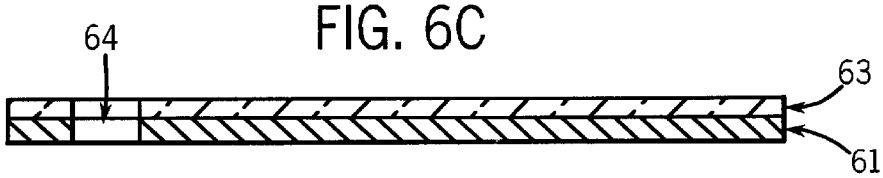

REUSABLE INFORMATION TAG

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Invention

This invention relates generally to erasable labels and more specifically to a reusable information tag for use with gifts, luggage and the like.

2. Background Art

It is frequently desirable to identify the owner, user or intended recipient of an article merely by glancing at the exterior of the article. For example, gifts often need external identification to clarify the giver and the intended recipient so that the proper person unwraps the gift and knows who gave it to him or her. Similarly, luggage often needs external identification so that the owner can readily distinguish his or her luggage from other people's similar-looking luggage. This is especially useful in places where the luggage has been grouped together, such as airports. External identification also allows others to quickly and easily determine ownership of lost articles. For these and other reasons, people frequently place external information tags on gifts, luggage, band instruments, backpacks, gym bags, sports equipment, and myriad other items.

The current state of the art in gift tags is exemplified by the paper gift tags widely used at Christmas. These usually have holiday-related scenes printed on one side, along with the words "TO" and "FROM." The gift giver writes her name after "FROM" and the intended recipient's name after "TO." These tags typically are attached to the gift with a piece of adhesive tape applied from the tag to the gift wrapping paper. Some tags have an adhesive strip, which is covered with protective paper, such as wax-coated paper, already attached to the back. The user peels the protective paper from the strip, then sticks the tag to the gift.

Identification tags for luggage typically consist of a piece of heavyweight paper with blank lines for the name, address and telephone number of the owner, along with a plastic or leather case to hold and protect the piece of paper once it has been filled out. The paper slides into the case and the information thereon can be read through a transparent piece of plastic on one side of the case.

In addition to their practical function, information tags often have a decorative function. As noted, gift tags frequently have decorations printed on them, such as red and green Christmas ornaments. Identification tags sometimes come in fancy leather cases with designs, and possibly a retailer's name, tooled into them. This serves both a decorative function and provides advertising for the company.

Current-art gift and identification tags are generally meant to be written upon only once. If the user writes on the tag with a felt or ball point pen, the writing cannot be removed without damaging the tag. Even if the user writes on the tag with a pencil, erasing the names will generally damage any graphics and indicia on the tag, as well as the tag itself. As a result, gift tags are usually thrown away once the gift has been opened. Although identification tags often have a longer life span, for the same reasons they are still limited to the information initially placed on them.

Current-art gift tags also suffer frequent attachment failure. Due to the fact that the tags are designed to be for only one usage of short duration, manufacturers generally make the tags from relatively insubstantial materials, such as heavy paper. It is therefore not unusual to find in actual use that the tags have become separated from the gifts, leaving one to guess at which tag belongs with which gift.

Moreover, adhesive tape generally cannot be removed from the front of the gift tag without damaging, or even destroying, the tag. Adhesive strips applied to the back of the tag are also difficult to separate from the gift or the tag and are intended for one-time use.

Current-art gift and identification tags are significantly limited in decorative variety by the fact that the graphics and indicia are printed on or otherwise directly applied to the top surface of the tag. This method results in an appreciable cost associated with changing the decorations on the tags. Manufacturers therefore generally prefer to produce large numbers of tags with the same few decorative styles. Where a separate protective case is provided, such as with many luggage tags, the cost of the tag is greatly increased. Moreover, there is very little flexibility in changing the decorative design of the case, giving consumers little choice if they desire personalized identification tags which show their individual interests.

For example, it would be desirable to provide identification tags to all of the members of a school band for their instrument cases. More desirable and fun would be to provide each member with an identification tag which, in addition to the lines for the name, address and telephone number, would have a graphic of that student's instrument, such as a trumpet, on the face of the tag. Even more desirable would be to have these tags be inexpensive yet durable even when subjected to rain and snow, with no need for a separate case. Still more desirable would be to have these tags be reusable each year by new students, who could simply erase the last student's identifying information and fill in the new student's identifying information.

It should also be recognized that many people enjoy handicrafts. They receive considerable pleasure from making articles which they and others can enjoy for years to come. This is especially true when the articles reflect their artistic skills and have personal significance to them or the people to whom they give their handicrafts.

Erasable labels are known. U.S. Pat. No. 4,757,901 to Woods (1988); U.S. Pat. No. 5,024,332 to Stachler (1991); U.S. Pat. No. 5,040,296 to Yerger (1991); and U.S. Pat. No. 5,186,499 to Mason (1993) disclose typical erasable labels. These generally are intended for video cassettes, floppy disks, and the like. Although they can be written upon and erased without damage to the label, they are not meant to be transferred from article to article. In fact, they teach the use of adhesive coatings on the backside for permanent attachment to one article. Moreover, they do not provide for a separate middle layer on which is disposed graphics and indicia. They also teach the use of special dry and wet erase markers. As a gift tag, this would greatly limit reusability by anyone who receives the tag, since it is not practical to include a special pen with each gift for reuse of the gift tag. As an identification tag, which is likely to be subjected to considerable wear and even inclement weather, including rain, it is questionable whether the information printed on such a label would survive. Erasable labels also rely on reuse instructions printed on the packaging or on a separate piece of paper. Accordingly, they are not readily transferrable from person to person, since it is not practical to include a copy of the reuse instructions with each label.

Therefore, there is a need for an improved information tag which is inexpensive, durable and reusable by anyone having common household items such as felt markers, isopropyl rubbing alcohol, string and adhesive tape; which can be economically manufactured with numerous different graphics and indicia for every holiday, occasion, event, use and interest; and which can also be made from kits by private individuals in their own homes.

SUMMARY

The present invention satisfies this need. A reusable information tag comprises a substantially flat substrate; a middle layer on which are disposed graphics and indicia, the middle layer being bonded to the substrate; a top layer comprising a transparent or translucent non-porous erasable film or sheet adapted to receive writing, the top layer being bonded to the middle layer; and a means for attachment comprising a through hole and a string, wire, cord, twine, ribbon, band, strap or similar flexible elongated material providing strength and durability sufficient for the intended use. Reuse instructions may be disposed on the tag. Alternatively, no middle layer is provided and the graphics and indicia are disposed upon the top surface of the substrate or upon the bottom surface of the top layer. In use, the information tag is attached to a gift, luggage or other article, and written upon with a felt marker or other writing instrument. The writing may be thereafter easily erased with a cloth or tissue and water or alcohol, depending on the type of pen used, and the tag reused by the original user or by a new user. The tag may be reused with either the same article or a different article.

In an embodiment, the present invention provides a kit for making a reusable information tag. In an embodiment, the present invention provides a method for manufacturing a reusable information tag.

Accordingly, an object and advantage of the invention is to provide an improved information tag which is reusable both because the information can be easily erased and new information written on the tag and because the tag has a means for attachment which allows it to be easily detached from one article and re-attached to another article.

Another object and advantage of the invention is to provide a reusable information tag which has a decorative and informative layer which can be easily and inexpensively changed during manufacturing so as to allow for the cost-effective manufacturing of numerous versions for every holiday, occasion, event, use and interest without significant changes in the production line. Thus gift tags for Hanukkah, birthdays, awards ceremonies and weddings may be manufactured at little or no extra cost over gift tags limited to one decorative design. Reusable gift and identification tags may be made for tennis, gardening or scuba enthusiasts, or any other special interest. Advertising, such as a retailer's name, may be easily incorporated into gift and identification tags, even when produced in small quantities.

Another object and advantage of the invention is to provide a reusable information tag which can be written upon with common household items, such as felt and ball point pens, not smudge or smear under long and rough use, but quickly and easily erase with isopropyl rubbing alcohol, fingernail polish remover or a similar common household solvent without any damage to the tag.

Another object and advantage of the invention is to provide a reusable information tag which has a means for attachment that allows it to be securely attached to an object, then easily removed from that object, without damage to the tag, and quickly and securely fastened to another object using common household items, for example string and adhesive tape.

Another object and advantage of the invention is to provide a reusable information tag which is extremely durable and does not need a protective case.

Another object and advantage of the invention is to provide a reusable information tag which has bright, attractive, decorative graphics and indicia which are protected during use and, unlike labels with indicia on the outer top surface, do not interfere with the information written over them.

Another object and advantage of the invention is to provide an inexpensive kit with which individuals can make personalized, durable, reusable information tags having all of the above qualities. For environmental, aesthetic and sentimental reasons, these tags may be used over and over within the same family or by anyone receiving them with a gift or even as a gift.

These and other features, aspects and advantages of the present invention will become better understood from a study of the following description, accompanying drawings and appended claims.

BRIEF DESCRIPTION OF THE SEVERAL VIEWS OF THE DRAWINGS

FIG. 4A is a front perspective view of a first embodiment of a reusable information tag.

FIG. 4B is an exploded front perspective view of the reusable information tag of FIG. 4A.

FIG. 4C is a side sectional view of the reusable information tag taken along line 4C—4C in FIG. 4A.

FIG. 6A is a front perspective view of a third embodiment of a reusable information tag.

FIG. 6B is an exploded front perspective view of the reusable information tag of FIG. 6A.

FIG. 6C is a side sectional view of the reusable information tag taken along line 6C—6C in FIG. 6A.

DRAWING REFERENCE NUMERALS

10. Reusable Information Tag
11. Hole
12. String
13. Adhesive Tape
14. Graphics and Indicia

20. Reusable Information Tag
21. Slot
22. Strap
23. Buckle
24. Graphics and Indicia
30. Reusable Information Tag
31. Slot
32. Strap
33. Buckle
34. Reuse instructions
40. Reusable Information Tag
41. Substrate
42. Middle Layer
42A. Top Surface of Middle Layer
43. Graphics and Indicia
44. Top Layer
45. Hole
46. Reuse instructions
50. Reusable Information Tag
51. Substrate
51A. Top Surface of Substrate
52. Graphics and Indicia
53. Top Layer
54. Slot
60. Reusable Information Tag
61. Substrate
62. Graphics and Indicia
63. Top Layer
63A. Bottom Surface of Top Layer
64. Hole

DETAILED DESCRIPTION OF THE INVENTION

Introduction to FIGS. 1 through 6C

Figure 1:
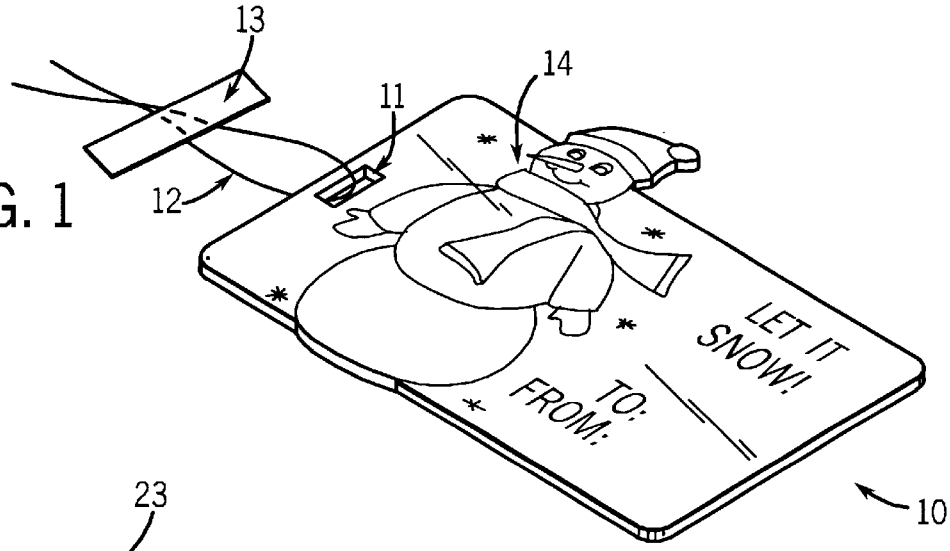
FIG. 1 is a front perspective view of a reusable information tag in accordance with first, second and third embodiments of the invention.
Figure 2:
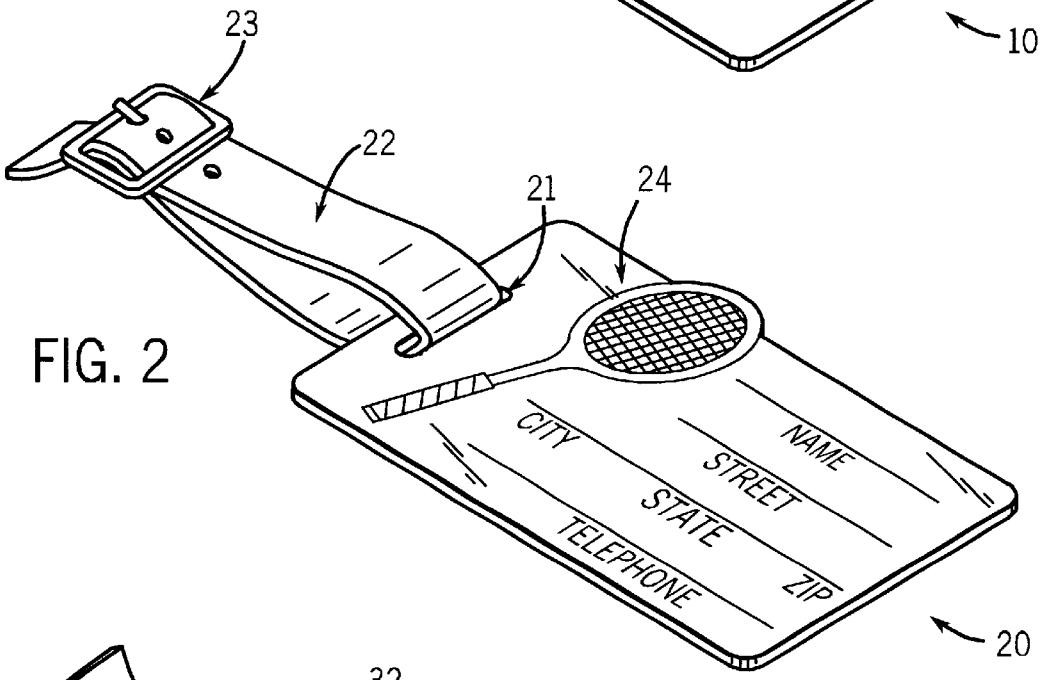
FIG. 2 is a front perspective view of a reusable information tag in accordance with first, second and third embodiments of the invention.

The reusable information tags shown in FIGS. 1 through 6C include specific graphics and indicia, as well as specific shapes. These are merely for purposes of example and are not meant to be limitations on the invention. An unlimited variety of graphics and indicia may be disposed upon the reusable information tags. The tag may be any shape, such as a simple rectangle as shown in FIG. 4A, or a rectangle with protrusions as shown in FIG. 1 and FIG. 2. It may also be oval, circular, star-shaped, football-shaped for sports lovers, French Horn-shaped for musicians, or any other shape pleasing to the maker. The only limitations regarding shape are that the invention should be substantially flat on the top and bottom sides so as to allow for ease of manufacture and use, and in keeping with the objects and advantages of the invention. Similarly, the through hole 45 shown in FIG. 4A could just as easily be slot-shaped, as shown in FIGS. 1 and 2, or any other shape, e.g., a hexagon, as long as it extends completely through the tag 40 from top to bottom.

Description—FIG. 1—Front Perspective View

FIG. 1 shows a front perspective view of a reusable gift tag 10 with illustrative graphics and indicia 14 comprising a snowman, the words "LET IT SNOW" and "TO:" and "FROM:". A means for attachment comprises a through hole 11 disposed near an edge of the gift tag 10, through which is looped a string 12. With a strip of adhesive tape 13, the user tapes both ends of the string 12 to a gift or other article (not shown). Alternative means for attachment are described in detail below under "OPERATION-ALL EMBODIMENTS." The outward appearance is the same whether the tag 10 is constructed in either the first, second or third embodiments of the invention, which are shown in FIGS. 4A through 6C and described in detail below.

Description—FIG. 2—Front Perspective View

FIG. 2 shows a front perspective view of a reusable identification tag 20 with illustrative graphics and indicia 24 comprising a tennis racquet, lines, and words beneath the lines directing the user in the placement of identifying information. A means for attachment comprises a through slot 21 disposed near an edge of the identification tag 20, through which is looped a strap 22. A buckle arrangement 23 attached to the ends of the strap 22 allows the user to buckle the strap 22 around a handle on a piece of luggage, a strap on a backpack, sports equipment or any other article (not shown) the user wishes to place identifying information upon. Alternative means for attachment are described in detail below under "OPERATION-ALL EMBODIMENTS." The outward appearance is the same whether the tag is constructed using either the first, second or third embodiments of the invention, which are shown in FIGS. 4A through 6C and described in detail below.

Figure 3:
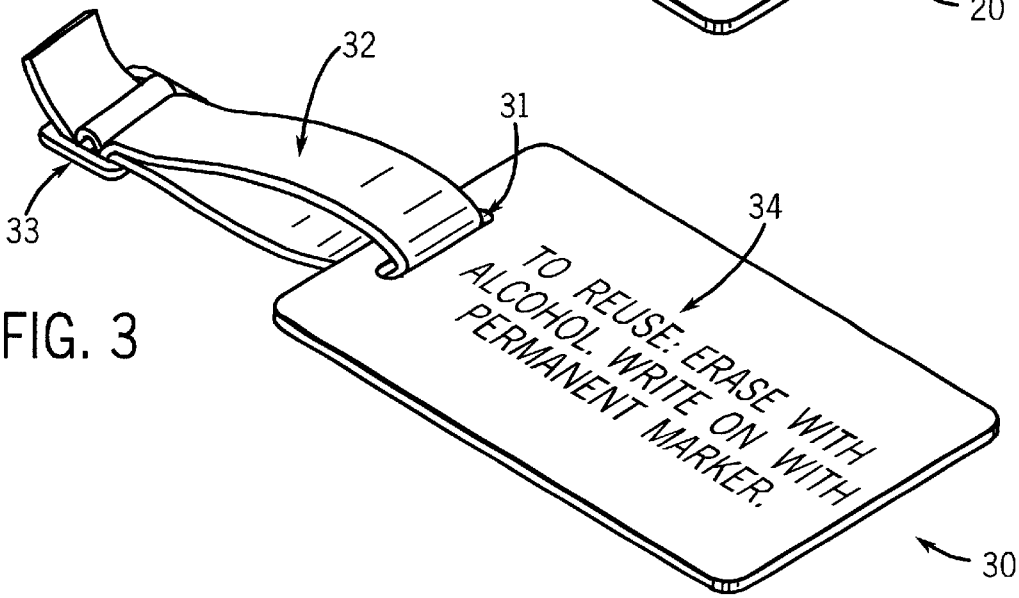
FIG. 3 is a rear perspective view of a reusable information tag in accordance with first, second and third embodiments of the invention.

Description—FIG. 3—Rear Perspective View

FIG. 3 shows a rear perspective view of a reusable information tag 30 constructed in either the first, second or third embodiments of the invention, which are shown in FIGS. 4A through 6C and described in detail below. Of particular importance in FIG. 3 are the functional indicia providing reuse instructions 34. Unlike current-art gift and identification tags, this invention is specifically intended to be usable by an unlimited number of people. The use of one-use gift and identification tags is generally self-explanatory and understood by most people, making instructions unnecessary. Reusable labels usually come with instructions included in or on their packaging so that the purchaser knows how to use them properly. However, it is not practical to include separate reuse instructions with a gift tag attached to a gift. The recipient of a gift tag who unsuccessfully tries to erase the giver's and recipient's names with a dry or wet cloth, where an alcohol-soluble ink has been used, may well conclude that the tag is not reusable and throw it away. In fact, many people who are familiar with current-art gift and identification tags may not even think about trying to reuse the tags. Obviously, this would defeat one of the primary purposes of the invention. Therefore, reuse instructions may be disposed upon the tag.

In FIG. 3, the reuse instructions 34 are disposed on the back of the tag 30. However, the positioning of the reuse instructions is not critical. The reuse instructions may be printed upon the back of the tag, disposed upon a separate sticker affixed to the back of the tag, made a part of the graphics and indicia 46 disposed upon the tag 40 as shown in FIG. 4B, or otherwise positioned on or within the tag. Likewise, the exact wording of the reuse instructions is not critical, provided the solubility of the type of ink suggested and the erasure solvent are compatible. Other examples of reuse instructions include "To Reuse, Wipe With Alcohol and Write on With Felt Pen," "Erase With Alcohol; Permanent Markers Work Best," "Erase with Alcohol and Reuse," and the like.

Also shown in FIG. 3 are a means for attachment comprising a through slot 31 disposed near an edge of the identification tag 30, through which is looped a strap 32. A buckle arrangement 33 attached to the ends of the strap 32 allows the user to buckle the strap 32 around a handle on a piece of luggage, a strap on a backpack, sports equipment or any other article the user wishes to place identifying information upon. Alternative means for attachment are described in detail below under "OPERATION-ALL EMBODIMENTS."

Description—FIG. 4A—First Embodiment Front Perspective View

In accordance with a first embodiment of the invention, FIG. 4A shows a front perspective view of a reusable gift tag 40 with a through hole 45 near an edge of the tag 40. Illustrative graphics and indicia 43 comprising a Christmas tree and the words "TO:" and "FROM:" are displayed along with reuse instructions 46. It should be understood that this could just as well be an identification tag by simply changing the graphics and indicia 43.

Description—FIG. 4B—First Embodiment Exploded Perspective View

FIG. 4B shows an exploded perspective view of the reusable information tag of FIG. 4A. The tag comprises a substantially flat substrate 41 comprising a sheet of plastic, cardboard, wood, metal or other material providing protection to a middle layer 42 and durability sufficient for the tag's intended use and lifespan. Plastic is the preferred material. The middle layer 42 comprises a sheet of paper, plastic or other material adapted to receive graphics and indicia 43 on its top surface 42A. Paper is the preferred material. Graphics and indicia 43 may be disposed onto the top surface 42A of the middle layer 42 by generating the graphics and indicia 43 on a computer using software and printing them onto the top surface 42A of the middle layer 42 with a printer. Alternatively, the graphics and indicia 43 may be disposed upon the top surface 42A by hand using suitable paints and inks, by screen printing, by offset printing, by sublimation, and by similar conventional techniques. The preferred method for home kits is using a personal computer, software and printer. The preferred method for commercial manufacture is screen printing.

Numerous adhesive bonding agents well known in the art, such as glue and contact cement, may be used to bond the middle layer 42 to the substrate 41. It should be noted, however, that some adhesive bonding agents bleed through standard 20 lb. and 24 lb. printer papers, rendering the graphics and indicia 43 unattractive. It is therefore preferable to use heavier stock paper to ensure that no bleed-through occurs.

A top layer 44 comprising a nonporous erasable film or sheet adapted to receive writing, such as polypropylene, is bonded to the middle layer 42. The top layer 44 must be either transparent or translucent so that the graphics and indicia 43 on the top surface 42A of the middle layer 42 may be viewed through the top layer 44. The top layer 44 may be tinted or untinted, as long as the graphics and indicia are readable through it. Numerous adhesive bonding agents well known in the art may be used to bond the top layer 44 to the middle layer 42, with the limitation that the adhesive bonding agent must be transparent upon drying and not damage the graphics and indicia 43.

A through hole 45 is disposed near an edge of the tag 40. The means for attachment is as shown in FIGS. 1, 2 and 3, and described below under "OPERATION-ALL EMBODIMENTS".

FIG. 4B also demonstrates the functional use of reuse instructions 46 as part of the graphics and indicia 43.

Description—FIG. 4C—First Embodiment Side Sectional View

In accordance with the first embodiment of the invention, FIG. 4C shows a side sectional view of the three layers of the reusable information tag 40 taken along line 4C—4C in FIG. 4A when the layers of the tag are properly bonded together. Thus, the substrate 41, middle layer 42, and top layer 44 are visible. The preferred bond between the layers is generally continuous so as to avoid any bubbling or movement of the layers. The through hole 45 extending from top to bottom through the tag 40 and disposed near an edge of the tag 40 can also be seen.

Figure 5A:
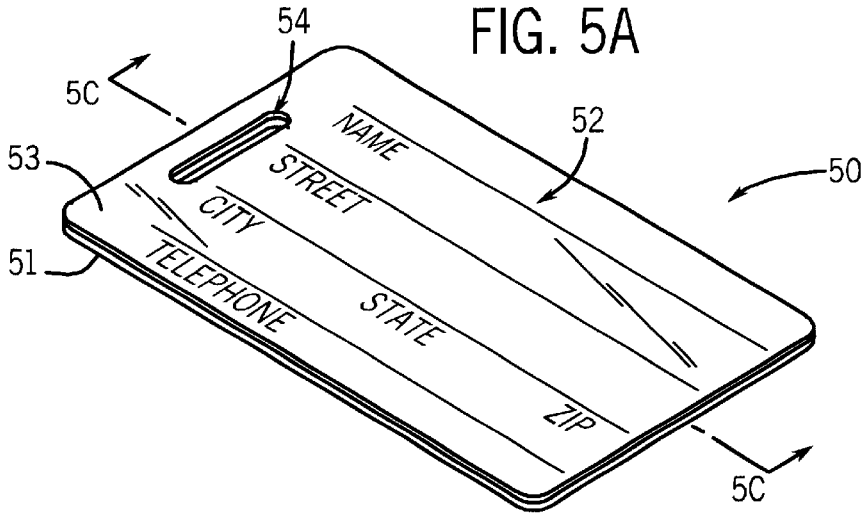
FIG. 5A is a front perspective view of a second embodiment of a reusable information tag.

Description—FIG. 5A—Second Embodiment Front Perspective View

In accordance with a second embodiment of the invention, FIG. 5A shows a front perspective view of a reusable identification tag 50 with a through slot 54 near an edge of the tag 50. Illustrative graphics and indicia 52 comprising lines and words beneath the lines directing the user in the placement of identifying information are displayed. It should be understood that this could just as well be a gift tag by simply changing the graphics and indicia 52.

Figure 5B:
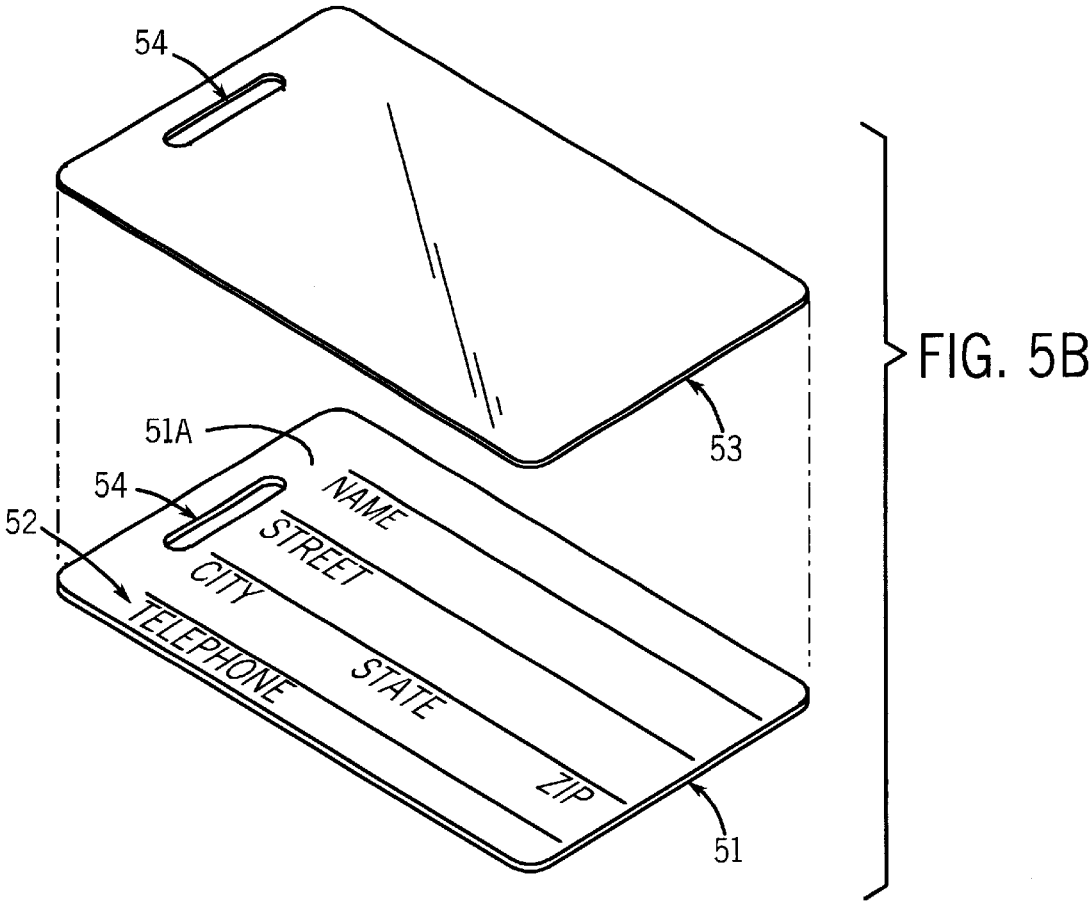
FIG. 5B is an exploded front perspective view of the reusable information tag of FIG. 5A.

Description—FIG. 5B—Second Embodiment Exploded Perspective View

FIG. 5B shows an exploded perspective view of the reusable information tag 50 of FIG. 5A. The tag 50 comprises a substantially flat substrate 51 comprising a sheet of plastic, cardboard, wood, metal or other material adapted to receive graphics and indicia 52 on its top surface 51A and providing protection to the graphics and indicia 52 along with durability sufficient for the tag's intended use and lifespan. Plastic is the preferred material. The graphics and indicia 52 are disposed directly onto the top surface 51A of the substrate 51. The graphics and indicia 52 may be disposed onto the top surface 51A by generating the graphics and indicia on a computer using software and printing them onto the top surface 51A with a printer. Alternatively, the graphics and indicia may be disposed upon the top surface 51A by hand using suitable paints and inks, by screen printing, by offset printing, by sublimation, and by similar conventional techniques. The preferred method for home kits is using a personal computer, software and printer. The preferred method for commercial manufacture is screen printing.

A top layer 53 comprising a nonporous erasable film or sheet adapted to receive writing, such as polypropylene, is bonded to the substrate 51. The top layer 53 must be either transparent or translucent so that the graphics and indicia 52 on the top surface 51A of the substrate 51 may be viewed through the top layer 53. The top layer 53 may be tinted or untinted, as long as the graphics and indicia are readable through it. Numerous adhesive bonding agents well known in the art may be used to bond the top layer 53 to the substrate 51, with the limitation that the adhesive bonding agent must be transparent upon drying and not damage the graphics and indicia 52.

A through slot 54 is disposed near an edge of the tag. The means for attachment is as shown in FIGS. 1, 2 and 3, and described below under "OPERATION-ALL EMBODIMENTS".

Figure 5C:
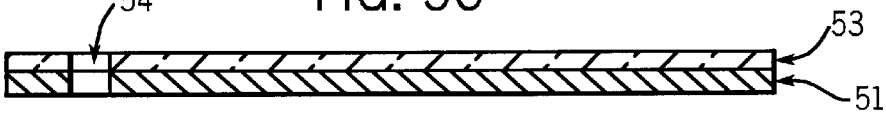
FIG. 5C is a side sectional view of the reusable information tag taken along line 5C—5C in FIG. 5A.

Description—FIG. 5C—Second Embodiment Side Sectional View

In accordance with the second embodiment of the invention, FIG. 5C shows a side sectional view of the two layers of the reusable information tag 50 taken along line 5C—5C in FIG. 5A when the layers of the tag 50 are properly bonded together. Thus, the substrate 51 and top layer 53 are visible. The preferred bond between the layers is generally continuous so as to avoid any bubbling or movement of the layers. The through slot 54 extending from top to bottom through the tag 50 and disposed near an edge of the tag 50 can also be seen.

Description—FIG. 6A—Third Embodiment Front Perspective View

In accordance with a third embodiment of the invention, FIG. 6A shows a front perspective view of a reusable gift tag 60 with a through hole 64 near an edge of the tag 60. Illustrative graphics and indicia 62 comprising a Christmas tree and the words "TO:" and "FROM:" are displayed. It should be understood that this could just as well be an identification tag by simply changing the graphics and indicia 62.

Description—FIG. 6B—Third Embodiment Exploded Perspective View

FIG. 6B shows an exploded front perspective view of the reusable information tag 60 of FIG. 6A. The tag 60 comprises a substantially flat substrate 61 comprising a sheet of plastic, cardboard, wood, metal or other material providing protection to the graphics and indicia 62 and durability sufficient for the tag's intended use and lifespan. Plastic is the preferred material. A top layer 63 comprising a nonporous erasable film or sheet adapted to receive writing on its top surface, such as polypropylene, is provided. Graphics and indicia 62 are disposed directly upon its bottom surface 63A. The graphics and indicia 62 may be disposed onto the bottom surface 63A of the top layer 63 by generating the graphics and indicia 62 on a computer using software and printing them onto the bottom surface 63A with a printer. Alternatively, the graphics and indicia 62 may be disposed upon the bottom surface 63A by hand using suitable paints and inks, by screen printing, by offset printing, by sublimation, and by similar conventional techniques. The preferred method for home kits is using a personal computer, software and printer. The preferred method for commercial manufacture is screen printing.

The top layer is bonded to the substrate 61. The top layer 63 must be either transparent or translucent so that the graphics and indicia 62 on the bottom surface 63A of the top layer 63 may be viewed through the top layer 63. The top layer 63 may be tinted or untinted, as long as the graphics and indicia 62 are readable through it. Numerous adhesive bonding agents well known in the art may be used to bond the top layer 63 to the substrate 61, with the limitation that the adhesive bonding agent must be transparent upon drying and not damage the graphics and indicia 62.

A through hole 64 is disposed near an edge of the tag 60. The means for attachment is as shown in FIGS. 1, 2 and 3 and described below under "OPERATION-ALL EMBODIMENTS".

Description—FIG. 6C—Third Embodiment Side Sectional View

In accordance with the third embodiment of the invention, FIG. 6C shows a side sectional view of the two layers of the reusable information tag 60 taken along line 6C—6C in FIG. 6A when the layers of the tag are properly bonded together. Thus, the substrate 61 and top layer 63 are visible. The preferred bond between the layers is generally continuous so as to avoid any bubbling or movement of the layers. The through hole 64 extending from top to bottom through the tag 60 and disposed near an edge of the tag 60 can also be seen.

OPERATION-ALL EMBODIMENTS

All three embodiments of the reusable information tag are used in the same way. Referring to the first embodiment (FIGS. 4A through 4C) as an example, the user writes his or her name upon the top surface of the top layer 44 of the reusable information tag 40 after the word "FROM:", which is disposed beneath and clearly visible through the top layer 44. The user writes the intended gift recipient's name on the top surface of the top layer 44 after the word "TO:", which is also disposed beneath and clearly visible through the top layer 44. Viable writing instruments include felt markers, ball point pens, dry erase markers and wet-erase markers. The preferred writing instrument is a felt marker. More preferred is a permanent felt marker. These pens dry rapidly on the nonporous erasable top surface of the tag 44 and will not smear or accidentally erase in normal or even rugged use.

Turning to FIG. 1, a gift tag 10 is attached to a gift (not shown) by looping a string 12 through a through hole 11 in the tag 10, placing the ends of the string 12 upon the gift, then placing a piece of adhesive tape 13 across the ends of the string 12 so that the string 12 is affixed to the gift. Turning to FIG. 2, an identification tag 20 is attached to a piece of luggage (not shown) by looping a free end of a band 22 with a buckle 23 through a slot 21 in the tag 20, then looping the free end of the band 22 through a handle or strap on the luggage (not shown), and fastening the free end of the band 22 to the buckle 23.

After the gift has been opened, the user or the recipient reuses the tag 10 by snipping the string 12 with a pair of scissors or otherwise removing the adhesive tape and string from the gift wrapping. The user or recipient then erases the user's and recipient's names with isopropyl rubbing alcohol and a cloth or tissue where a felt marker, including a permanent marker, or ball point pen was used. If a wet-erase marker was used, the writing is erased with water and a cloth or tissue. Writings made with a dry erase marker may be removed with a cloth or tissue alone, or even with a finger. New information may then be written upon the tag 10 and the tag 10 attached to a new article, all as described above. The graphics and indicia on the reusable information tag do not change the method of using the tag. Thus, an identification tag 20 is erased and reused in the same manner, with the exception that the identification tag 20 will generally require a stronger strap or band 22 than required by the gift tag 10.

Alternatively, the string 12 may be replaced with a wire, cord, ribbon, band, strap or similar flexible elongated material providing strength and durability sufficient for the intended use. Alternatively, the band 22 may be replaced with a strap, wire, cord, twine, ribbon or similar flexible elongated material providing strength and durability sufficient for the intended use. Rather than using a buckle arrangement 23, the ends of the band may be secured around the luggage handle or strap by means of fastening tape consisting of opposing pieces of fabric, one with a dense arrangement of tiny nylon hooks and the other with a dense nylon pile, that interlock when pressed together. In fact, any one of the numerous traditional ways of attaching tags to gifts, luggage and other articles may be used. For example, the tag 20 may simply be tied to the luggage, backpack, or other article being identified. Alternatively, a continuous loop of cord (not shown) may be inserted through the through hole 11 then back through itself to form a double-stranded loop around the tag 10. The continuous loop may then be looped around the gift. This is especially effective with identification tags 20, where the continuous loop and tag 20 may be looped though the handle of the luggage then doubled back through itself to also form a double-stranded loop around the handle. This is simple, inexpensive and reusable. Alternatives to adhesively taping the string 12 or similar flexible elongated material to the gift comprise gluing or tying the string 12 to the gift. As is apparent, the method of attaching the reusable information tag to another article is not critical as long as the materials used and the method are sufficiently strong for the intended use and easily removed for reuse. In fact, the method can be as simple as tying a string to the tag and to the article.

Returning to FIGS. 4A through 4C, in an embodiment of a kit for making the first embodiment of a reusable information tag 40, the user creates graphics and indicia 43 using software already existing on the user's personal computer (not shown) or using software provided with the kit and loaded onto the user's personal computer. Still working on the computer, the user formats the prepared graphics and indicia 43 to a size and shape suitable for a reusable information tag 40, for example a rectangle 5.1 cm high by 7.6 cm wide (2 inches by 3 inches) or smaller for a gift tag and 7.6 cm high by 12.7 cm wide (3 inches by 5 inches) or smaller for an identification tag, and enters a command for the computer to send the graphics and indicia 43 to a printer (not shown). The printer prints the graphics and indicia 43 onto standard 20 lb. printer paper, heavier stock printer paper such as brochure paper, photo-quality printer paper, plastic sheets adapted to receive printing, and the like. It should be noted, however, that some adhesive bonding agents bleed through standard 20 lb. and 24 lb. printer papers, rendering the graphics and indicia 43 unattractive. It is therefore preferable to use heavier stock paper to ensure that no bleed-through occurs. The middle layer may or may not be provided with the kit. The user cuts out the graphics and indicia disposed upon the printer paper or other stock using a pair of scissors (not shown). The user has now prepared a middle layer 42 of a reusable identification tag 40 of the first embodiment.

Alternatively, the graphics and indicia 43 may be disposed upon the top surface 42A by hand using suitable paints and inks, by screen printing, by offset printing, by sublimation, and by similar conventional techniques. The preferred method for kits is using a personal computer, software and printer.

Using an adhesive bonding agent, such as glue, which may or may not be supplied with the kit, the user bonds the middle layer 42 to a substrate 41 provided with the kit. The substrate 41 comprises a substantially flat sheet of plastic, cardboard, wood, metal or other material providing protection to the middle layer 42 and durability sufficient for the tag's intended use and lifespan. Plastic is the preferred material. The top surface 42A of the middle layer 42 must face away from the substrate 41. Thus, the bottom surface, i.e. the side opposite the top surface 42A of the middle layer 42, is the side being bonded with the substrate 41. The substrate 41 provided with the kit may be pre-cut to sizes and shapes appropriate for gift and identification tags, for example a rectangle 5.1 cm high by 7.6 cm wide (2 inches by 3 inches) or smaller for a gift tag and 7.6 cm high by 12.7 cm wide (3 inches by 5 inches) or smaller for an identification tag, or the substrate 41 may be provided in larger sheets, for example 21.6 cm wide by 27.9 cm high (8½ inches by 11 inches). In the latter case, the user cuts out with a pair of scissors the now-bonded substrate 41 and middle layer 42 from the larger sheet.

Using a transparent bonding agent, the user bonds a top layer 44 to the middle layer 42. The top layer 44 provided with the kit comprises a nonporous erasable film or sheet adapted to receive writing on its top surface, such as polypropylene. The top layer 44 must be either transparent or translucent so that the graphics and indicia 43 on the top surface 42A of the middle layer 42 may be viewed through the top layer 44. The top layer 44 may be tinted or untinted, as long as the graphics and indicia are readable through it. The top layer 44 provided with the kit may be pre-cut to sizes and shapes appropriate for gift and identification tags, for example a rectangle 5.1 cm high by 7.6 cm wide (2 inches by 3 inches) or smaller for a gift tag and 7.6 cm high by 12.7 cm wide (3 inches by 5 inches) or smaller for an identification tag, or the substrate 41 may be provided in larger sheets, for example 21.6 cm wide by 27.9 cm high (8½ inches by 11 inches). If the substrate 41 and top layer 44 are provided in pre-cut sizes and shapes, the sizes and shapes should match one another.

Finally, the user punches a through hole 45 near an edge of the tag 40 using a standard hole punch, which may or may not be provided as a part of the kit. Alternatively, the substrate 41 and top layer 44 may come in the kit with pre-punched holes, especially where the substrate 41 and top layer 44 are in pre-cut sizes and shapes.

Alternatively, the kit may include a middle layer 42 comprising printer paper which has an adhesive coating on its bottom surface covered by a peel-off protective layer, such as wax-coated paper, so that the user may simply peel off the protective layer and attach the middle layer 42 to the substrate 41 after printing the graphics and indicia 43 on the top surface 42A of the middle layer 42. Alternatively, the kit may include a substrate 41 further comprising an adhesive coating on its top surface covered by a peel-off protective layer, such as wax-coated paper, so that the user may simply peel off the protective layer and attach the top surface of the substrate 41 to the bottom surface of the middle layer 42. The kit may also include a top layer 44 further comprising a transparent adhesive coating on its bottom surface covered by a peel-off protective layer, such as wax-coated paper, so that the user may simply peel off the protective layer and attach the top layer 44 to the middle layer 42.

Alternatively, a kit may be provided for making reusable information tags in either the second or third embodiments of the invention. Referring to FIGS. 5A through 5C, rather than providing for a separate middle layer with graphics and indicia disposed upon it, as described above, the kit for making the second embodiment of the invention replaces the middle layer with a substrate 51 comprising a substantially flat sheet of plastic, cardboard, wood, metal or other material adapted to receive graphics and indicia 52 on its top surface 51A and providing protection to the graphics and indicia 52 along with durability sufficient for the tag's intended use and lifespan. Plastic is the preferred material. The kit for the tag 50, would otherwise be as described above for the first embodiment kit, including the alternatives described above. The second embodiment kit may also include a transparent adhesive backing covered by a protective layer, such as wax-coated paper, on the bottom surface of the top layer 53 so that the user may simply peel off the protective layer and attach the top layer 53 to the substrate 51.

Referring to FIGS. 6A through 6C, rather than providing for a separate middle layer with graphics and indicia disposed upon it, as described above, the kit for making the third embodiment of the invention would replace the middle layer with a top layer 63 comprising a nonporous erasable film or sheet adapted to receive writing on its top surface and graphics and indicia 62 upon its bottom surface 63A, such as polypropylene. The kit for the tag 60, would otherwise be as described above for the first embodiment kit, including the alternatives described above. The third embodiment kit may also include an adhesive coating covered by a protective layer, such as wax-coated paper, on the top surface of the substrate 61 so that the user may simply peel off the protective layer and attach the top layer 63 to the substrate 61.

In an embodiment, the present invention provides a method for manufacturing a reusable information tag 40 that comprises the steps of providing a substantially flat substrate 41 comprising a sheet of plastic, cardboard, wood, metal or other material providing protection to a middle layer 42 and durability sufficient for the tag's intended use and lifespan; providing a middle layer 42 comprising a sheet of paper, plastic or other material adapted to receive graphics and indicia 43 on its top surface 42A; providing a top layer 44 comprising a transparent or translucent nonporous erasable film or sheet which may be tinted or untinted and is adapted to receive writing, such as polypropylene; generating graphics and indicia 43 for printing on the middle layer 42; printing the graphics and indicia 43 on the top surface 42A of the middle layer 42; bonding the middle layer 42 onto the substrate 41 with the graphics and indicia 43 facing upwards; bonding the top layer 44 to the middle layer 42; and punching a through hole near an edge of the tag 40. Referring to FIGS. 5A through 5C, alternatively the graphics and indicia 52 may be disposed directly upon the top surface 51A of the substrate 51, with no middle layer being provided. Referring to FIGS. 6A through 6C, alternatively the graphics and indicia 62 may be disposed directly upon the bottom surface 63A of the top layer 63, with no middle layer being provided.

Alternatively, the graphics and indicia 43, 52 and 62, respectively, may be disposed upon the top surface 42A of the middle layer 42, the top surface 51A of the substrate 51, and the bottom surface 63A of the top layer 63 by hand using suitable paints and inks, by screen printing, by offset printing, by sublimation, and by similar conventional techniques. The preferred method for commercial manufacture is screen printing.

Numerous bonding agents well known in the art, such as glue and contact cement, may be used to bond the middle layer 42 to the substrate 41. It should be noted, however, that some bonding agents bleed through standard 20 lb. and 24 lb. printer papers, rendering the graphics and indicia 43 unattractive. It is therefore preferable to use heavier stock paper to ensure that no bleed-through occurs.

Numerous bonding agents well known in the art may be used to bond the top layer 44 to the middle layer 42, with the limitation that the bonding agent must be transparent upon drying and not damage the graphics and indicia 43.

CONCLUSION, RAMIFICATIONS, AND SCOPE

Accordingly, the reader will see that this invention provides an improved information tag which is inexpensive, durable and reusable with common household products; which can be economically manufactured with numerous different graphics and indicia for every holiday, occasion, event, use and interest; and which can also be made from kits by private individuals in their own homes. Although the above descriptions are specific, they should not be considered as limitations on the scope of the invention, but only as examples of the preferred embodiment. Many additional ramifications and variations are possible within the teachings of the invention. For example, simply by changing the size, graphics and indicia, the reusable information tag could be a reusable two-sided greeting card. Therefore, the scope of the invention should not be determined by the examples given, but by the appended claims and their legal equivalents.

What is claimed is:

1. A reusable information tag comprising:

a) a substrate comprising a bottom surface and a top surface;

b) a nonporous top layer allowing substantial visibility there through and comprising a bottom surface and an erasable top surface adapted to receive writing thereon from a writing instrument containing solvent-erasable ink such that the writing can be erased from the top surface only by use of a solvent;

c) means for disposing graphics and indicia between the top surface of the substrate and the bottom surface of the top layer such that the graphics and indicia are visible through the top layer;

d) a bonding agent adhesively bonding the layers of the tag such that the graphics and indicia are disposed between the substrate and the top layer and are visible through the top layer;

e) means for attaching the tag to other articles;

f) a writing instrument containing solvent-erasable ink; and g) a solvent for erasing the writing disposed upon the top surface of the top layer by the writing instrument containing solvent-erasable ink.

2. A kit for providing a custom reusable information tag, the kit comprising:

a) a substrate comprising a bottom surface and a top surface;

b) a nonporous top layer allowing substantial visibility there through and comprising a bottom surface and an erasable top surface adapted to receive writing thereon from a writing instrument containing solvent-erasable ink such that the writing can be erased from the top surface only by use of a solvent;

c) means for disposing graphics and indicia between the top surface of the substrate and the bottom surface of the top layer such that the graphics and indicia are visible through the top layer;

d) means for attaching the tag to other articles;

e) a writing instrument containing solvent-erasable ink; and f) a solvent for erasing the writing disposed upon the top surface of the top layer by the writing instrument containing solvent-erasable ink.

3. The method of claim 1 further comprising disposing reuse instructions upon the tag so that any recipient of the tag will understand that the tag is reusable and the method of its reuse.

4. A method providing a writable information tag which will withstand long, harsh use but be readily erasable and reusable when desired, the method comprising the following steps:

a) providing a substrate comprising a bottom surface and a top surface;

b) providing a nonporous top layer allowing substantial visibility there through and comprising a bottom surface and an erasable top surface adapted to receive writing thereon from a writing instrument containing solvent-crasable ink such that the writing can be erased from the top surface only by use of a solvent;

c) generating graphics and indicia;

d) disposing the graphics and indicia between the top surface of the substrate and the bottom surface of the top layer such that the graphics and indicia are visible through the top layer;

e) adhesively bonding the layers of the tag such that the graphics and indicia are disposed between the substrate and the top layer and are visible through the top layer;

f) providing a means for attaching the tag to other articles;

g) writing information upon the tag with a writing instrument containing solvent-erasable ink; and h) using a solvent to erase the information written upon the tag with the writing instrument containing solvent-erasable ink.

* * * * *

UNITED STATES PATENT AND TRADEMARK OFFICE

CERTIFICATE OF CORRECTION

PATENT NO. : 6,550,813 B1
DATED : April 22, 2003
INVENTOR(S) : Donna J. Siegrist It is certified that error appears in the above-identified patent and that said Letters Patent is hereby corrected as shown below:

Column 14,
Line 51, change "3. The method of claim 1" to -- 4. The method of claim 3 --.
Line 56, change claim number "4" to claim number -- 3 --.

Signed and Sealed this

Twenty-eighth Day of October, 2003

JAMES E. ROGAN
*Director of the United States Patent and Trademark Office*